United States Patent [19]

Monson

[11] Patent Number: 5,048,123

[45] Date of Patent: Sep. 17, 1991

[54] GARMENT WITH 3-DIMENSIONAL INFLATABLE DESIGN

[76] Inventor: Demetrius A. Monson, 535 S. Mesa Hills Dr., #1618, El Paso, Tex. 79912

[21] Appl. No.: 590,457

[22] Filed: Oct. 3, 1990

[51] Int. Cl.[5] ..... A41D 1/02

[52] U.S. Cl. ..... 2/69; 2/108; 2/85; 2/93; 2/DIG. 3

[58] Field of Search ..... 2/69, 85, 93, 108, 171.3, 2/DIG. 3, DIG. 1, DIG. 10

[56] References Cited

U.S. PATENT DOCUMENTS

| | | | |
|---|---|---|---|
| D. 175,789 | 10/1955 | Massey | D3/4 |
| D. 298,580 | 11/1988 | Diaz | D2/183 |
| 2,632,176 | 3/1953 | Mitchell | 2/202 |
| 4,310,927 | 1/1982 | De Bose | 2/115 |
| 4,404,689 | 9/1983 | Dewan | 2/247 |
| 4,513,451 | 4/1985 | Brown | 2/69 |
| 4,608,715 | 9/1986 | Miller et al. | 2/108 |
| 4,655,563 | 5/1987 | Harvey | 2/87 |
| 4,665,563 | 5/1987 | Harvey | 2/87 |
| 4,689,831 | 9/1987 | Greenberger et al. | 2/108 |
| 4,731,833 | 3/1988 | Foster | 2/247 |
| 4,731,883 | 3/1988 | Foster | 2/247 |
| 4,796,304 | 1/1989 | Shelby | 2/94 |
| 4,813,081 | 3/1989 | Cliff et al. | 2/115 |
| 4,815,149 | 3/1989 | Erhardt | 2/244 |
| 4,837,864 | 6/1989 | Thill | 2/244 |
| 4,875,237 | 10/1989 | Cohen | 2/94 |

*Primary Examiner*—Werner H. Schroeder
*Assistant Examiner*—Gloria Hale
*Attorney, Agent, or Firm*—Knobbe, Martens, Olson & Bear

[57] ABSTRACT

The present invention relates to 3-dimensional novelty apparel and comprises a lightweight jacket having a self-inflatable air pocket attached to the back of the garment and a design affixed to the exterior face of the air pocket. The preferred embodiment of the novelty garment incorporates a jacket design of rather conventional configuration wherein an opening is provided in a rear panel to accept a 3-dimensional design air pocket securely sewn to the rear panel about the opening. In an alternative embodiment, the 3-dimensional air pocket is sewn on the back of a conventional jacket having a continuous rear panel, wherein a plurality of relatively small holes are provided in the rear panel to permit the passage of air therethrough. The self-inflatable air pocket comprises generally a discreet panel having an outer panel and a side panel attached to the outer panel about its perimeter. The side panel comprises a plurality of segments secured together to form a continuous side panel.

26 Claims, 1 Drawing Sheet

Fig. 1
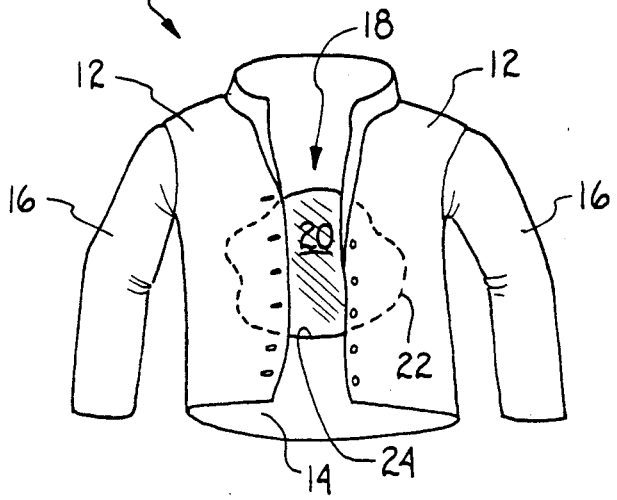
Fig. 4
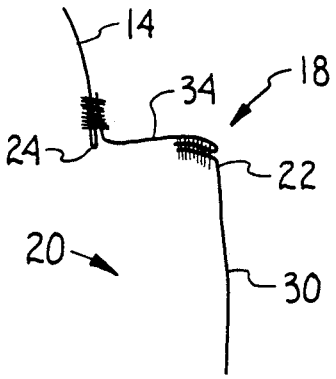
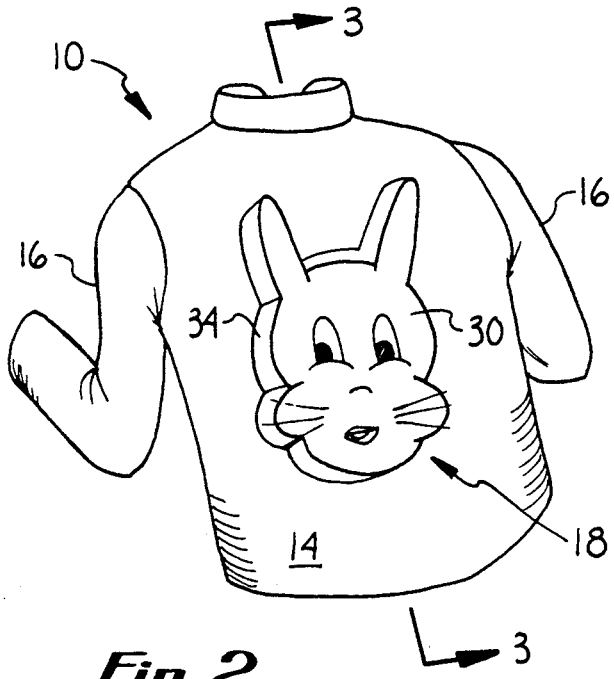
Fig. 2
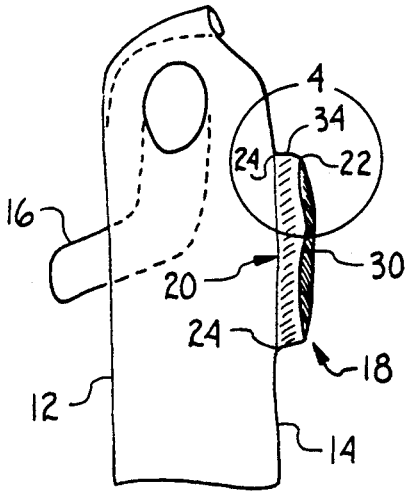
Fig. 3

GARMENT WITH 3-DIMENSIONAL INFLATABLE DESIGN

FIELD OF THE INVENTION

The present invention relates to novelty clothing in general and, in particular, a garment having a 3-dimensional design incorporated thereon.

BACKGROUND OF THE INVENTION

Novelty clothing and apparel have become increasingly popular over the years to the extent that there are entire retail outlets geared solely towards T-shirts, sweatshirts, jackets and accessories having novelty characteristics. Most people are familiar with various such apparel that feature caricatures and other humorous designs and slogans imprinted thereon. Such apparel is commercially successful as it permits the wearer to make a statement or to stand out in a crowd. Indeed, novelty clothing often brings delight and even pride to the wearer, as well as entertaining others who see the novelty clothing.

Traditionally, novelty apparel included mostly T-shirts and sweatshirts having two-dimensional pictures or slogan schemes printed on the front and/or back panels of the shirt. For example, it is common to see T-shirts with cartoon characters, movie characters or sports figures emblazoned on the shirt for all to see. The pleasure of wearing such novelty apparel often comes from receiving a response from passers-by when exhibiting the two-dimensional design or slogan emblazoned thereon. Indeed, in many cases, the more unusual the design, the more effective the novelty apparel and more pleasing to the user, ultimately resulting in greater sales.

As expected, with two-dimensional imprints on novelty clothing, there is a limit with which a person can be creative with the imprinted designs. While there are numerous designs and slogan that can be used, the manner in which they can be expressed on the clothing is limited to a flat imprint. As a result, there have been generated in the prior art, 3-dimensional novelty clothing such as found in the patents to Erhardt, et al., U.S. Pat. No. 4,815,149 and Thill, U.S. Pat. No. 4,837,864, in which is disclosed a molded 3-dimensional design affixed to one face of an article of clothing. With the advent of 3-dimensional clothing, the extent of creativity possible in generating appealing novelty clothing was expanded, wherein the possibilities of 3-dimensional effects could be fully exploited. The 3-dimensional designs of Thill and Erhardt, et al., are molded and form a relatively rigid relief pattern that is not subject to change under normal use. Such designs are constructed of rubberized or plastic material which is affixed in some manner to the clothing.

While a 3-dimensional design adds a new dimension to the creative expression, it is generally inert. As a result, these novelty articles lack the added dimension found in the present invention—that of "coming to life". In addition, the manufacturing costs associated with rubberized or plastic, molded, 3-dimensional designs are sufficiently cost ineffective in comparison to conventional 2-dimensional designs directly imprinted on the article of clothing. Consequently, there is a need to develop a 3-dimensional design that enhances the amusement generated by the wearer and passers-by while providing a cost effective novelty item.

SUMMARY OF THE INVENTION

The present invention has significantly expanded on the concept of 3-dimensional novelty apparel by providing a 3-dimensional character that, in effect, "comes to life" when worn by the wearer. Such a unique feature heightens the pleasure which one feels when wearing the novelty apparel. Generally, the present invention comprises a lightweight jacket having a self-inflatable air pocket attached to the back of the garment and a design affixed to the exterior face of the air pocket.

In one embodiment, the novelty garment of the present invention incorporates a jacket design of rather conventional configuration, preferably having a connectable set of front panels, a rear panel, and two sleeves. An opening is provided in the rear panel to accept a 3-dimensional design air pocket, which is securely sewn to the rear panel thereon about the perimeter of the opening. In an alternative embodiment, the 3-dimensional air pocket is sewn on the back of a conventional jacket having a continuous rear panel, wherein a plurality of relatively small holes are provided in the rear panel to permit the passage of air therethrough and thereby inflate the pocket.

In the preferred embodiment, the self-inflatable air pocket comprises generally a discreet panel having an outer panel and a side panel attached to the outer panel about its perimeter. The side panel comprises a plurality of segments secured together to form a continuous side panel. However, it is contemplated that the side panel be constructed of a single segment. Furthermore, it is also contemplated that the outer panel and side panel be of unitary construction.

Preferably made of highly pliable material, the air pocket lays relatively flat against the jacket when not inflated. In the preferred embodiment, the jacket and air pocket attached thereto are constructed of non-woven spunbonded polyolefin, such as Tyvek TM . However, it is contemplated that any lightweight pliable material having similar characteristics will be suitable for effective use.

The side panel on the air pocket provides a ring of excess material that permits the design on the air pocket to be displayed in a substantially two-dimensional format when the jacket is not worn or is while the wearer is standing relatively still. In this arrangement, the air pocket is suspended from the opening in the rear of the jacket in a manner such that the design rests closely to the rear panel of the jacket. However, when inflated in a manner described below, the side panel functions to separate the design on the outer panel of the air pocket to stand out and away from the rear panel of the jacket so as to create a 3-dimensional effect. When inflated, the side panel is oriented substantially orthogonal to the perimeter of the outer panel of the air pocket.

The preferred embodiment of the jacket is configured to permit the passage of air from the front of the jacket into the rear interior portion when the jacket is worn in an open fashion; i.e., when the front of the jacket is left open. In an alternative embodiment, one or more vents are provided in the sides of the jacket so that air may enter the rear of the jacket when the jacket is worn in a closed fashion.

When the wearer of the present invention moves at a slightly brisk pace, or when the wearer is facing the wind, the surrounding air is funneled to the rear of the jacket so as to capture the air within the air pocket. There the jacket is seen "puffed up" as wind is trapped in the rear portion of the jacket. With the present invention, the jacket material is advantageously lightweight so as to permit a significant capture of air merely by walking about. Certainly on a windy day, the wearer need not even move, as the wind will generate the desired effect on its own.

When air flows into the rear interior portion of the jacket, the air is captured within the air pocket. Upon an influx of air within the air pocket, the 3-dimensional design is inflated so as to bring the design to life. Depending on a change in wind conditions as one wears the jacket outdoors, it will be appreciated that the dimensional character will alternatively inflate and deflate periodically, further enhancing the vitality of the design.

In an alternative embodiment, a portion of the 3-dimensional design is imprinted in a two-dimensional fashion on the rear panel of the jacket while the balance of the design is imprinted on a 3-dimensional format air pocket. With this arrangement, the present invention creatively provides a more visually aesthetic effect, as a seemingly realistic contrast is provided.

It may be appreciated that, as with two-dimensional designs found in the art, there are a plethora of designs available for use with the present invention. For example, and not by way of limitation, popular cartoon characters are contemplated for use on the lightweight jacket. Alternatively, movie characters, famous stars and famous places are also contemplated, wherein the design is seemingly brought to life upon inflation of the air pocket.

BRIEF DESCRIPTION OF THE DRAWINGS

FIG. 1 is a front view of the novelty jacket of the present invention.

FIG. 2 is a rear perspective view of the novelty jacket showing a 3-dimensional design in an inflated position.

FIG. 3 is a cross-sectional view of the novelty jacket of FIG. 1 taken along lines 3—3 of FIG. 2.

FIG. 4 is an enlarged cross-sectional view of a portion of the 3-dimensional air pocket that is attached to the rear of the novelty jacket.

DETAILED DESCRIPTION

Reference is now made to the figures wherein like parts are designated with like numerals throughout. The present invention comprises a garment having a 3-dimensional self-inflatable design. While the preferred embodiment of the garment is a lightweight jacket, as described more fully below, other garments are contemplated, such as T-shirts, sweatshirts and pants.

Referring to FIG. 1, the preferred embodiment of the present invention is a novelty jacket 10 comprising a set of connectable front panels 12, a rear panel 14 and two sleeves 16 positioned therebetween. It may be appreciated from FIG. 1 that the jacket of the present invention is of preferably conventional shape and configuration and constructed of lightweight material as described below. The jacket is somewhat similar to the popular "windbreakers" worn so often in moderate temperature environments and in windy conditions.

At the rear of the novelty jacket 10 is an inflatable air pocket 18 secured about an opening 20 in the rear panel 14. A periphery 22 of the inflatable air pocket 18 is directly engaged with a continuous edge 24 of opening 20 so as to form a continuous air pocket extending outwardly from the novelty jacket 10. In an alternative embodiment, air pocket 18 is secured directly to the back of a conventional jacket having a continuous rear panel 14, (i.e., without opening 20) wherein a plurality of small holes are provided to permit the passage of air therethrough and thereby inflate pocket 18. With this embodiment, a number of variously-shaped pockets may be used in conjunction with the same conventional jacket, the pockets merely being substituted for each other as desired.

Referring to FIG. 2, a more complete view of the inflatable air pocket 18 can be seen. In the preferred embodiment, the inflatable air pocket 18 is secured to rear panel 14 of jacket 10 in such a fashion that the inflatable air pocket 18 may be readily displayed from behind the wearer. The inflatable air pocket 18 comprises a flat outer panel 30 having a two-dimensional design 32 imprinted thereon, the face panel 30 having a size and shape corresponding to the edge of design 32. Secured about the perimeter of outer panel 30 is a side panel 34 which functions to position the design 32 at a distance from rear panel 14 of the novelty jacket 10. As such, when the air pocket 18 is inflated, it assumes a 3-dimensional characteristic. When the air pocket 18 is not inflated, the air pocket 18 sags downwardly and rests close to the back of the jacket in a substantially 2-dimensional fashion (not shown). It may be appreciated that the inflatable air pocket 18 alternatively inflates and deflates as air is captured within the air pocket 18 so as to bring the design 32 to "life' when the jacket is worn.

In the preferred embodiment, the air pocket 18 is inflated when air is permitted to enter the jacket when worn open in the front, so that the air is funneled to the rear of the jacket. In an alternative embodiment, the jacket 10 is provided with one or more vents (not shown) in the side of the jacket to permit the passage of air to the rear of the jacket when the jacket is worn in a closed fashion. The vents may consist of a panel of porous mesh constructed integral with the side of the jacket or it may consist of a pivotal window which may be opened or closed to permit inflation of the air pocket 18.

Referring to FIG. 3, the 3-dimensional aspect of the inflatable air pocket 18 may be more fully appreciated. There is can be seen that the inflatable air pocket 18 comprises an outer panel 30 secured to side panel 34 about its periphery 22. The outer panel 30 is, in turn, secured to the rear panel 14 of novelty jacket 10 about the edge 24 of opening 20 so that inflatable air pocket 18 extends outwardly from the rear of jacket 10. In the preferred embodiment, the outer panel 30 extends approximately $3\frac{1}{2}''$ from the rear panel 14, which represents the width of side panel 34. However, the inflatable air pocket 18 may be of any size desired. The width of side panel 34 affects the distance the inflatable design 18 extends outwardly when inflated or the distance it sags downwardly when not inflated. Otherwise, the size of the inflatable design 18 may be varied considerably.

Referring to FIG. 4, engagement of the outer panel 30 to side panel 34 and engagement of the side panel 34 to rear jacket panel 14 may be more fully appreciated. In the preferred embodiment, outer panel 30 is constructed discretely from side panel 34. In turn, side panel 34 is preferably constructed of a plurality of segments secured together in a continuous manner, the side panel itself being constructed discretely from rear panel 14. Engagement of these discrete components therefore depends on a means for effectively securing the components together. Preferably, a small portion of an exposed edge of each of the three components is folded over and sewn to the adjacent component, as shown in FIG. 4. It is contemplated that means other than sewing also be used to secure the components together, i.e., a binding material such as glue suitable for textiles. It is to be understood that an arrangement of discrete panels is not intended to be a limitation on the present invention. Rather, in an alternative embodiment (not shown), the outer panel 30 and the side panel 34 are of unitary construction so that the air pocket 18 is a single unit. In either arrangement, the inflatable air pocket 18 may be readily secured to a conventional jacket by cutting an opening in the rear panel of the jacket to a size substantially the same as the size of the air pocket, and sewing the air pocket directly onto the rear panel of the jacket.

The novelty jacket of the present invention is preferably constructed of pliable lightweight material so that inflation of the inflatable air pocket 18 is easily permitted. While any lightweight material, such as nylon, may be effectively used, the preferred embodiment is constructed of non-woven spunbonded polyolefin, having a weight preferably of about 1.2 oz/square yard and commonly known as Tyvek TM. One of the advantages of Tyvek TM is its non-porous nature, which is functionally imperative in order to effectively inflate the inflatable design 18. Tyvek TM is also effective in accepting and maintaining a design impression using a four-color separated printing press which is commonly used in imprinting 2-dimensional designs on posters, magazines and other similar medium in the paper industry. Finally Tyvek TM is also easily washable without damaging the inflatable air pocket 18 on the design 32 imprinted thereon. It is to be understood, however, that other similar materials, such as nylon, will be effective for providing 3-dimensional inflation.

Referring momentarily back to FIG. 2, it can be appreciated that the design 32 can be one of any number of various designs or shapes desired. The embodiment depicted in FIG. 2 shows the design of a cartoon character. However, it is not intended as a limitation upon the available designs contemplated by the present invention. Any other designs may be utilized on the novelty jacket 10 such as other cartoon characters, movie insignias, places of interest, Hollywood stars, etc.

With the present invention, the excitement generated by wearing and exhibiting novelty apparel is further enhanced. By providing an inflatable design, the limited two-dimensional and molded 3-dimensional designs found in the prior art are given an added dimension to their ability to delight and amuse. In effect, the designs of the present invention are brought to life, offering a novel concept to the world of novelty apparel.

The present invention may be embodied in other specific forms without departing from its spirit or essential characteristics. Described embodiment is to be considered, in all respects, only as illustrative and not restrictive, and the scope of the invention is, therefore, indicated by the appended claims rather than by the foregoing description. All changes which come within the meaning and range of equivalency of the claims are to be embraced within their scope.

What is claimed:

1. A novelty garment comprising:

a jacket constructed of lightweight pliable material, said jacket having a connectable set of front panels, a rear panel attached to said front panels and a plurality of sleeves;

an opening in said rear panel of said jacket, said opening having a peripheral edge;

an air pocket comprising an outer panel and a side panel secured about a perimeter of said outer panel, said side panel also secured about the edge of said opening, said side panel comprising at least one segment of material, said air pocket secured substantially about an entire periphery of said air pocket to the edge of said opening so that said air pocket is in substantially continuous engagement with said rear panel, wherein the pocket is self-inflatable when the wearer is in motion or when said jacket is worn in windy conditions; and a design imprinted on said outer panel, the perimeter of said outer panel corresponding to an outer edge of said design.

2. The novelty garment as defined in claim 3, wherein the pliable, lightweight material is non-woven spunbonded polyolefin.

3. A novelty garment comprising:

a connectable set of front panels;

a rear panel attached to said front panels;

an opening in said rear panel, said opening having a peripheral edge, and an air pocket secured substantially about an entire periphery of said air pocket to the edge of said opening so that said air pocket is in substantially continuous engagement with said rear panel, wherein the pocket is self-inflatable when the wearer is in motion or in windy conditions.

4. The novelty garment as defined in claim 3, wherein the air pocket comprises:

an outer panel, and a side panel secured about a perimeter of said outer panel, said side panel also secured about the edge of said opening, whereby said air pocket is of a substantially continuous construction so as to be inflatable.

5. The novelty garment as defined in claim 4, wherein the outer panel has a design imprinted thereon.

6. The novelty garment as defined in claim 5, wherein the perimeter of said outer panel corresponds to an outer edge of the design.

7. The novelty garment as defined in claim 3, wherein the novelty garment is a jacket.

8. The novelty garment as defined in claim 3, wherein the novelty garment is constructed of pliable lightweight material.

9. The novelty garment as defined in claim 8, wherein the pliable, lightweight material is non-woven spunbonded polyolefin.

10. The novelty garment as defined in claim 8, wherein the pliable, lightweight material is nylon.

11. A novelty garment comprising:

a lightweight article of clothing having at least one opening provided in a rear panel thereof;

an air pocket secured substantially about an entire periphery of the openings, said air pocket being inflatable upon the passage of air into said air pocket, and a design imprinted on an exterior face of said outer panel.

12. The novelty garment as defined in claim 11, wherein the article of clothing is a jacket.

13. The novelty garment as defined in claim 12, wherein a plurality of holes are provided in the rear panel.

14. The novelty garment as defined in claim 12, wherein at least one vent is provided in the side of the jacket.

15. The novelty garment as defined in claim 11, wherein the novelty garment is constructed of pliable, lightweight material.

16. The novelty garment as defined in claim 13, wherein the pliable, lightweight material is non-woven spunbonded polyolefin.

17. The novelty garment as defined in claim 13, wherein the pliable, lightweight material is nylon.

18. A novelty garment comprising:

a connectable set of front panels;

a rear panel attached to said front panels;

at least one opening in said rear panel, and an air pocket secured substantially about an entire periphery of said air pocket to the rear panel so that said air pocket is in substantially continuous engagement with said rear panel and encloses said at least one opening, wherein the pocket is self-inflatable when the wearer is in motion or in windy conditions.

19. The novelty garment as defined in claim 18, wherein the air pocket comprises:

an outer panel, and a side panel secured about a perimeter of said outer panel, whereby said air pocket is of a substantially continuous construction so as to be inflatable.

20. The novelty garment as defined in claim 19, wherein the outer panel has a design imprinted thereon.

21. The novelty garment as defined in claim 20, wherein the perimeter of said outer panel corresponds to an outer edge of said design.

22. The novelty garment as defined in claim 18, wherein the garment has at least one vent positioned on the side of said garment for permitting the passage of air therethrough.

23. The novelty garment as defined in claim 18, wherein the novelty garment is constructed of pliable lightweight material.

24. The novelty garment as defined in claim 23, wherein the pliable, lightweight material is non-woven spunbonded polyolefin.

25. The novelty garment as defined in claim 23, wherein the pliable, lightweight material is nylon.

26. The novelty garment as defined in claim 11, said air pocket being comprised of an outer panel and a side panel which are discrete components.

* * * * *